United States Patent [19]

Wackerbarth et al.

[11] 4,382,772

[45] May 10, 1983

[54] INSERT TUBES FOR RICH GAS BURNERS IN THE HEATING FLUES OF COKE OVENS AND METHOD AND APPARATUS FOR INSERTING OR REMOVING THE SAME

[75] Inventors: Folkard Wackerbarth; Heinz Thubeauville; Horst Kleinert, all of Bochum, Fed. Rep. of Germany

[73] Assignee: Dr. C. Otto & Comp. G.m.b.H., Bochum, Fed. Rep. of Germany

[21] Appl. No.: 180,227

[22] Filed: Aug. 21, 1980

Related U.S. Application Data

[62] Division of Ser. No. 54,112, Jul. 2, 1979, abandoned.

[30] Foreign Application Priority Data

Jul. 7, 1978 [DE] Fed. Rep. of Germany ..... 2829845

[51] Int. Cl.[3] ..... F23C 5/06

[52] U.S. Cl. ..... 431/189; 202/141; 202/142

[58] Field of Search ..... 431/186, 189, 343; 266/225; 202/140, 141, 142

[56] References Cited

U.S. PATENT DOCUMENTS

| | | | |
|---|---|---|---|
| 2,746,913 | 5/1956 | Schurhoff | 202/142 X |
| 2,904,108 | 9/1959 | Blaha | 431/189 X |
| 3,072,540 | 1/1963 | Otto | 202/141 |
| 4,113,570 | 9/1978 | Pries | 202/141 X |

FOREIGN PATENT DOCUMENTS

| | | | |
|---|---|---|---|
| 492735 | 4/1926 | Fed. Rep. of Germany | 202/142 |
| 480746 | 7/1929 | Fed. Rep. of Germany | . |

OTHER PUBLICATIONS

Didier-Kellogg Nozzle #St 278a, 12/9/68.
Didier-Kellogg Nozzle #St 281, 11/27/68.

*Primary Examiner*—Samuel Scott
*Assistant Examiner*—Randall L. Green
*Attorney, Agent, or Firm*—Thomas H. Murray

[57] ABSTRACT

Burner tubes for coke oven heating flues and method and apparatus for inserting and/or removing the same from burner nozzles. The burner tubes themselves can be inserted or removed from burner nozzles permanently installed in the sole of a heating flue and comprise thin-walled alumina elements provided with external fins adapted to engage the top edges of the burner nozzles. The apparatus for inserting and removing the tubes comprises two pivotally-connected rods, the lower of which is adapted to carry either a fixture which can insert a burner tube into a burner nozzle or a fixture which can remove a burner tube. In either case, the fixture is such that it can be engaged with, or disengaged from, a burner tube by manipulation of the uppermost pivotally-connected rod without manual contact with the tube in the heating flue itself.

3 Claims, 12 Drawing Figures

INSERT TUBES FOR RICH GAS BURNERS IN THE HEATING FLUES OF COKE OVENS AND METHOD AND APPARATUS FOR INSERTING OR REMOVING THE SAME

This is a division, of application Ser. No. 54,112, filed July 2, 1979, now abandoned.

BACKGROUND OF THE INVENTION

As is known, in the usual by-product coke oven installation, an oven chamber is bounded on opposite sides by heating flues where coke oven gas or the like is burned to produce heat which passes through the oven walls to the coal being coked. In the heating flues, the combustible gas is introduced by means of nozzles extending upwardly from the sole of the flues. Inserted into these nozzles are refractory tubes of varying heights which produce flames at various heights within the flue to achieve a uniform heating pattern.

In the past, the various heights of the burner tubes could not be altered after initial construction of the coke oven installation. This is a disadvantage in that heating conditions may vary considerably with the kind of heating gas used and with the type of coal to be coked. It is, therefore, desirable, in order to produce a desired distribution of heat in the heating flues to provide a means for changing the heights of the burner tubes after the initial construction of the oven installation to accommodate different types of heating gases and coals to be coked.

In the past, arrangements such as that shown in German Pat. No. 480,746 have been devised for varying the heights of the burner tubes wherein interchangeable burner tubes of various heights are designed to be introduced downwardly from the roof of the oven through openings above the heating flues and then attached to burner nozzles permanently installed in the bottoms of the flues. The system disclosed in German Pat. No. 480,746, however, is impractical under present-day operating conditions for various reasons. The nozzles described in the aforesaid German patent, which are made of silica, are too large to be introduced through the presently-used inspection holes which are provided in the roof of the oven above the heating flues. While it would be possible to increase the inspection hole diameter, this would increase radiation losses excessively and impair the construction of the roof in other respects. Furthermore, tubes formed from silica as described in German Pat. No. 480,746, will crack and be destroyed if exposed suddenly to the temperature of the heated flues.

Whereas, by product coke ovens constructed 50 years ago had oven chamber heights no greater than about 4 meters, present-day ovens have chamber heights as great as 6 to 8 meters. This feature alone makes it much more difficult to achieve uniform heating along the length and height of the oven. Accordingly, a need exists to provide a means whereby the bottoms of the gas flames in the heating flues can be varied vertically, particularly since the requirements for uniform heating have increased to the extent that only very small temperature differences are permitted in the various layers of the coke cake before pushing.

SUMMARY OF THE INVENTION

In accordance with the present invention, a new and improved burner tube construction of variable height is provided which can readily pass through small diameter coke oven roof inspection openings and which can be readily installed in, or removed from, permanent burner nozzles in the sole or floor of a coke oven heating flue during normal operation of the oven (i.e., without having to cool the oven). The burner tubes of the invention are thin-walled and have outer diameters such that they will be in snug-abutting relationship with the inner periphery of an associated burner nozzle when inserted therein and are provided with external fins or lugs at one point along their lengths, these being adapted to engage the top edges of the burner nozzles. The dimensional tolerances in the burner tube diameter and the diameter of the burner nozzle are such that a perfect fit of the tube into the nozzle is impossible; however the fit should be good enough to prevent the egress of relatively large quantities of rich, combustible gas at the bottom of the tube which would result in flame formation. It has been found in practice that small quantities of gas which initially escape from the unavoidable gap between the burner tube and the burner nozzle will initially burn; however a graphite deposit forms very rapidly because of the slow gas flow in the gap; and a sealing graphite envelope soon forms.

Conventional coke oven materials such as silica and fire clay of varying alumina content have been found to be unsuitable as materials for the thin-walled burner tubes of the invention. Similarly, silicon dioxide is rapidly destroyed by the rich gas, which contains reducing components. Cracking and fracture occur with these materials; and they cannot withstand the abrupt change in temperature experienced upon introduction into the heating flues where the temperature is approximately 1200° C. It has been found, however, that substantially pure alumina ($Al_2O_3$), preferably a substance having an $Al_2O_3$ content of at least 99.9%, has proved satisfactory as a material for the tubes.

In accordance with another aspect of the invention, apparatus is provided for installing and removing burner tubes of the type described above through small diameter coke oven roof inspection openings. For installing a burner tube, a clevis at the bottom of a rod inserted through an inspection opening is provided with an arm pivotally connected between the two arms of the clevis at a point offset with respect to the axis of the rod. In this manner, one end of the arm will be heavier than the other such that it will naturally rotate into a vertical position. However, when a burner tube is inserted over the insertion rod, the weight of the tube, resting on the opposite ends of the pivotal arm, forces it to assume a horizontal position where it supports the tube vertically as the rod and tube are lowered down into the heating flue through the aforesaid inspection opening. Once the burner tube is inserted into an associated burner nozzle, however, the clevis and the arm pivotally carried thereon are simply lowered beneath the lower edge of the tube; whereupon the arm automatically rotates into a vertical position such that the entire assembly can be withdrawn from the interior of the tube which is now in place on the burner nozzle.

In order to remove a burner tube from a nozzle, link arms, pivotally connected to a clevis at the bottom of a rod inserted through an inspection opening in the flue roof, will pivot inwardly when they engage the top of a burner tube in place on a nozzle and will readily pass downwardly through the tube as the rod is lowered. However, when the link arms reach the bottom of the burner tube, they rotate outwardly under the force of gravity. Now, when the rod is pulled upwardly, the link arms will engage the bottom of the burner tube and pull it upwardly out of the burner nozzle and will support it as it is pulled upwardly through the inspection opening in the roof of the flue. The rod which is inserted through the inspection opening can also be provided at its lower end with a boring tool adapted to remove any deposits, such as graphite, from the inner periphery of the burner before inserting a new burner tube.

The aforesaid rod which raises or lowers the burner tubes into the heating flue is preferably formed from two sections which are pivotally interconnected. In this manner, the bottom section, having a burner tube inserted thereover, can be manipulated in a vertical direction on the coke oven roof above the heating flue; while the upper section hangs down from its pivotal connection to the lower section. After the lower section with the burner tube on it has been lowered into the flue, the top section can be rotated upwardly to form a vertical extension of the lower section. The pivotal connection between the upper and lower sections of the insertion rod can be such that the lower section of the rod is offset with respect to the upper section, thereby compensating for any offset in the axis of the inspection opening in the roof with the axis of the burner nozzle below.

The above and other objects and features of the invention will become apparent from the following detailed description taken in connection with the accompanying drawings which form a part of this specification, and in which.

Figures 1, 2, 3, 4A:
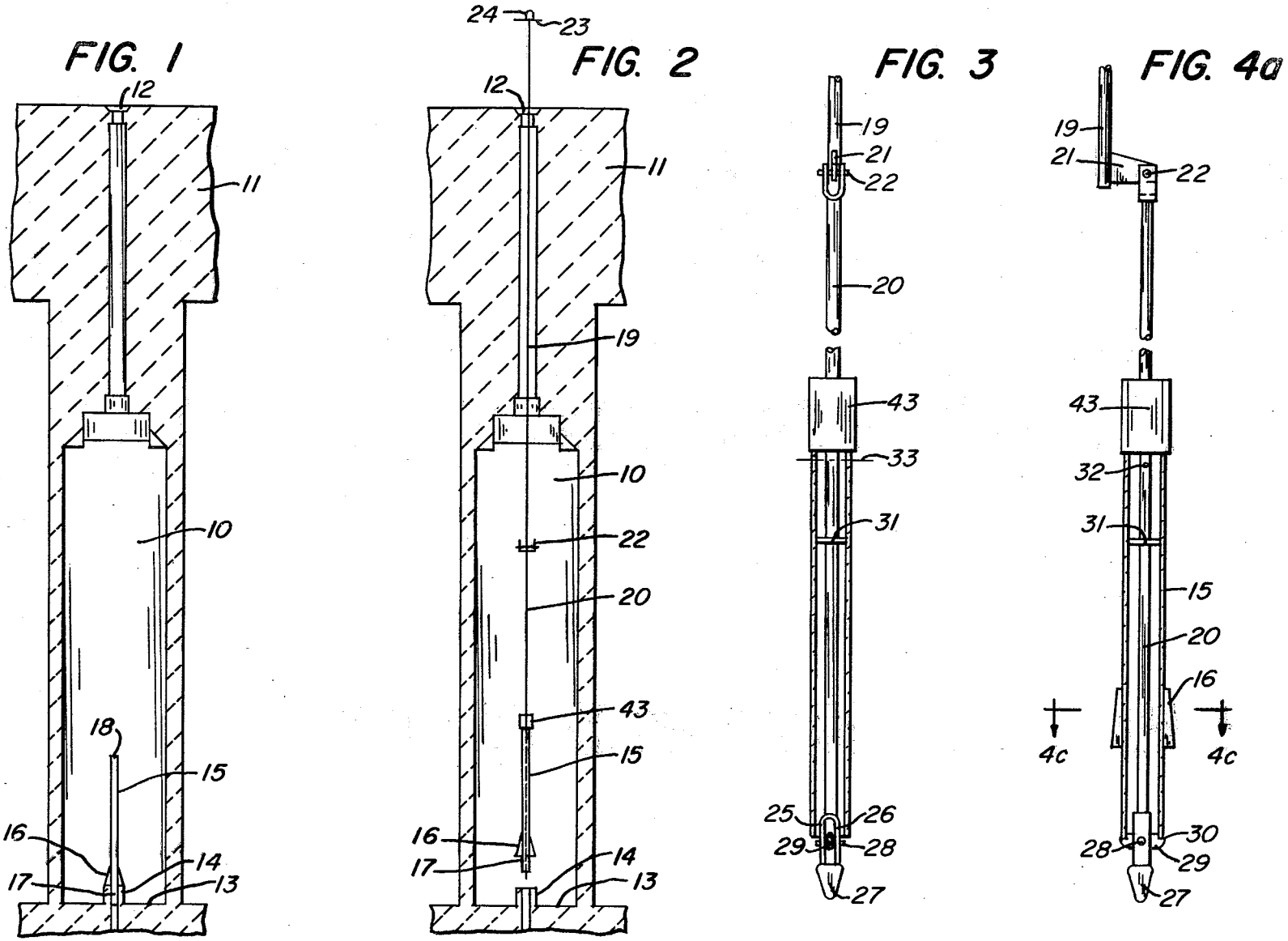
FIG. 1 is a vertical cross-sectional view through a heating flue of a recovery-type coke oven and oven roof showing the burner tube of the invention inserted into a burner nozzle at the sole of the flue.
FIG. 2 is a vertical cross-sectional view similar to that of FIG. 1, but showing the apparatus of the invention for engaging and lowering the burner tube down into alignment with a burner nozzle.
FIG. 3 is an elevational cross-sectional side view of the apparatus of the invention for inserting a burner tube into a burner nozzle.
Figure 4C:
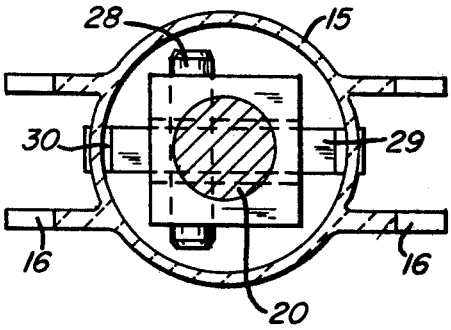
Figure 4B:
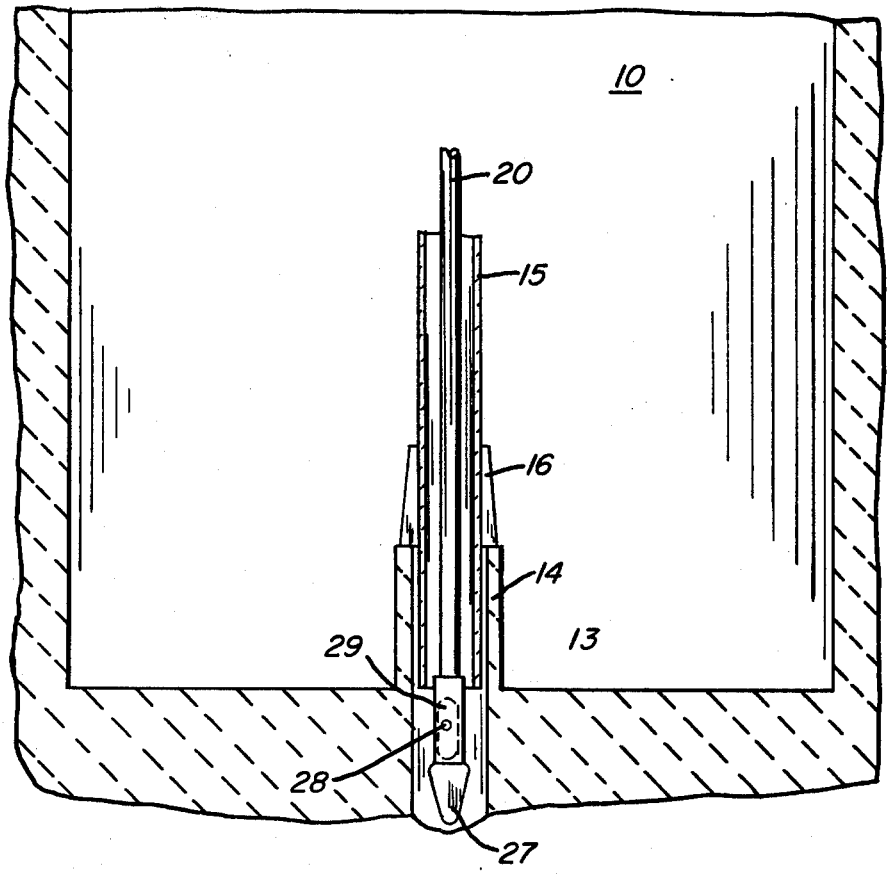

FIG. 4*a* is an elevational cross-sectional view, taken at 90° with respect to the cross-sectional view of FIG. 3;

FIG. 4*b* is a cross-sectional view similar to that of FIG. 4*a* but showing the position of the insertion rod and clevis arrangement of the invention after a burner tube has been inserted into a burner nozzle;

FIG. 4*c* is a cross-sectional view taken substantially along line C—C of FIG. 4*a;*

Figure 8:
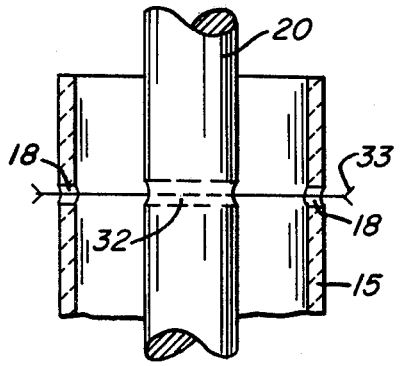
Figure 5:
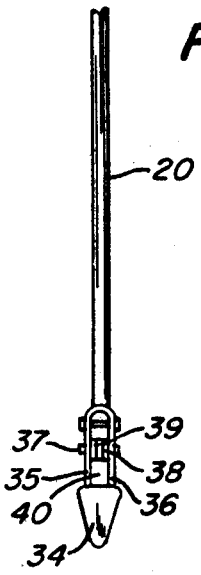
Figure 7:
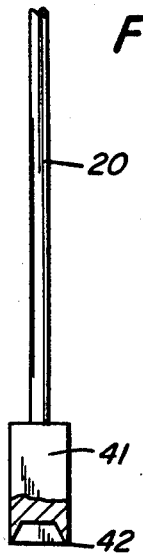
Figure 6A:
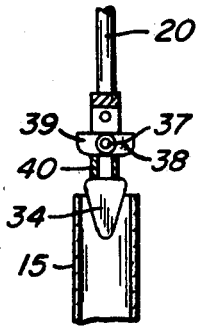
Figure 6B:
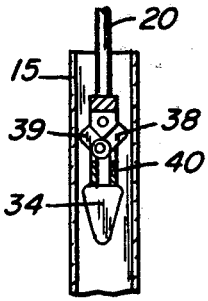
Figure 6C:
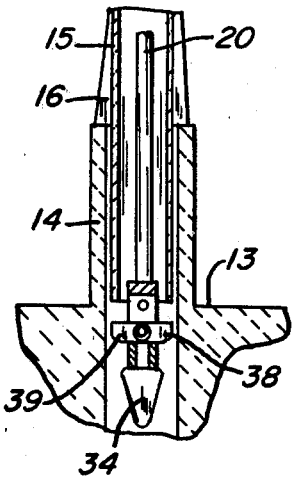

FIG. 5 is a side elevational view of the bottom end of a device for withdrawing a burner tube in accordance with the invention;

FIGS. 6*a*–6*c* are cross-sectional views, taken at 90° with respect to the view of FIG. 5, showing the withdrawal device of the invention in a position where it is above an installed burner tube, within the installed burner tube, and beneath the burner tube preparatory to the tube being withdrawn from a burner nozzle, respectively;

FIG. 7 is an illustration of a device for cleaning the burner nozzle before a burner tube is inserted therein; and FIG. 8 illustrates one manner in which a burner tube may be coaxially secured to an insertion rod.

With reference now to the drawings, and particularly to FIGS. 1 and 2, a coke oven heating flue is identified by the reference numeral 10. Above the flue 10 is the oven roof 11 having an inspection opening 12 extending therethrough. The sole of the flue 10 is identified by the reference numeral 13. Projecting upwardly from the sole 13 is a burner nozzle 14 having an internal cylindrical bore which is connected to a supply of combustible gas. Inserted into the bore of nozzle 14 is the burner tube 15 of the invention. In actual practice, there are a number of nozzles 14 and associated burner tubes 15 extending along the length of the flue 10 which projects into the plane of the drawing.

The details of the burner tube 15 are perhaps best shown in FIGS. 4*a* and 4*b*. It comprises a tubular, thin-walled member formed from alumina and having tapered lugs 16 projecting outwardly from its sides and spaced 180° apart. However, the number and nature of the lugs 16 can vary. For example, three lugs 16 can be disposed uniformly around the tube periphery at a 120° spacing, or four lugs can be disposed around the periphery at a 90° spacing. When the burner tube 15 is inserted into the bore of nozzle 14 as shown in FIG. 1, the bottoms of the lugs 16 will rest on the upper periphery of the nozzle 14 with the lower portion 17 of the tube 15 extending into and closely abutting the periphery of the bore in the nozzle. As was explained above, the dimensional tolerances of the bore in the nozzle and the outer periphery of the tube 15 should be such as to provide as snug a fit as possible. Initially, some combustible gas will ordinarily escape in the small gap between the outer periphery of the burner and the bore of nozzle 14; however graphite will quickly form in this area to cut off the flow of gas.

The wall thickness of the burner tube 15 should preferably be 6 millimeters or less. One wall thickness which has proved satisfactory is 4 millimeters. The cylindrical shape of the tube must be maintained very accurately to insure reliable introduction of the tubes into the apertures in the burners. The end 17 of tube 15 below the lugs 16 should preferably be at least 100 millimeters long. Tubes made of material containing at least 99.9% $Al_2O_3$ and having the wall thickness specified above can withstand being introduced in a cold condition through the inspection opening 12 and into the heating flue 10 where the temperature is approximately 1200° C. and where they abruptly experience radiation from the chamber walls. Stated in other words, the rapid temperature increase does not have any shock effect on such tubes. The lugs 16 should be formed of the same material and fired together with the tube 15. That is, the lugs 16 should be made from $Al_2O_3$ and pressed into the tube blank, following which the tube with the lugs formed thereon is fired.

FIG. 2 schematically illustrates the apparatus for removing or inserting a burner tube 15 through the inspection opening 12. It comprises a vertical rod having an upper section 19 and a lower section 20 which are pivotally connected as at 22. The upper section has at its upper end a retaining arm 23 and an eye or shackle 24 for suspending the rod on scaffolding or lifting tackle. As can be seen from FIGS. 3 and 4*a*, the upper section 19 of the rod can be provided with a horizontal arm 21 which carries, at its outer end, a pivot pin 22 connected to a clevis at the top of the lower rod section 20. The distance between the pivot pin 22 and the axis of the top section 19 can be made to correspond between the axis of the inspection opening 12 and the axis of an associated burner nozzle 14 which, under the conditions assumed, is disposed laterally of the axis of opening 12.

As is best shown in FIGS. 3 and 4*a*–4*c*, the bottom rod section 20 is provided at its lower end with a taper plug 27 for guiding the rod into the bore of burner nozzle 14. Between the plug 27 and the lower end of the lower rod section 20 is a clevis having opposed arms 25 and 26 through which a pivot pin 28 extends. The pin 28, as best illustrated in FIGS. 4*a* and 4*b*, is offset with respect to the axis of the rod section 20. Pivotally carried on the pin 28 is an arm 29 which has a width corresponding to the diameter of a burner tube 15 but which, due to the offset pivot pin connection to the aforesaid clevis, is heavier at one end (i.e., the right end in FIG. 4*a*) than at its opposite ends. When the arm 29 is rotated into its horizontal position as shown in FIGS. 3 and 4*a* and a tube is inserted over the rod section 20 with its lower end resting on the opposite ends of the arm 29, the arm will remain in the horizontal position shown in FIGS. 3 and 4*c* (See FIG. 4*c*). However, when the lower edge of the burner tube 15 no longer rests on the opposite ends of the arm 29, the heavier or right end of the arm 29 will cause it to rotate into the horizontal position shown in FIG. 4*b*.

When a burner tube 15 is lowered down through the inspection opening 12 and into the heating flue 10, it will rest on the arm 29 in the horizontal position shown in FIGS. 3 and 4*a*. However, when the burner tube 15 is inserted into the bore of nozzle 14 and the lugs 16 comes to rest on the upper periphery of the nozzle, continued downward movement of the rod sections 19 and 20 will separate the arm 29 from the lower edge of the tube 15; whereupon it rotates into the vertical position shown in FIG. 4*b*. Now, the rod section 20 and taper plug 27 may be readily withdrawn from the burner tube 15 which is in place in the burner nozzle 14.

In order to insure that the burner tube 15 is coaxial with the lower rod section 20, it may be provided with an annular washer 31 (FIGS. 3 and 4*a*) which spaces the tube 15 evenly around the axis of rod 20. The coaxial position of the tube 15 can also be insured by means of a vertically-movable cylindrical weight 43 slideable on the bottom rod section 20. The weight 43, which is of larger diameter than tube 15, acts to hold the tube 15 against the ends of arm 29. However, when the tube 15 is in place within the nozzle 14 and the rod section 20 withdrawn, the weight 43 settles down onto the annular washer 31.

Another method for insuring a coaxial condition between the rod section 20 and the tube 15 is shown in FIG. 8. The lower rod section 20 is provided with a transversely-extending bore 32 at the same height as apertures 18 formed in the wall of the tube 15. A thin wire 33 formed of a lowmelting material is passed through bore 32 and the openings 18 and drawn taut either by forming loops at its ends or by winding around the tube itself. This tends to maintain the tube 15 coaxial with the rod section 20. While the wire 33 retains the tube 15 loosely, it readily bends and ruptures as the rod section 20 is pulled upwardly with respect to a positioned burner tube.

To insert a burner tube in a nozzle 14, the tube 15 is first pushed upwardly over the arm 29 and onto the rod section 20. As the tube 15 moves upwardly, it passes over the washer 31; and after the lower edge of the tube clears the arm 29, the arm is manually rotated into a horizontal position and the tube permitted to settle thereon under the weight of the tube itself and the weight 43. The lower rod section 20 is then lowered through the inspection opening 12 in the roof until the top end of the lower section 20 projects slightly above the inspection opening 12. The top or upper rod section 19 is now rotated into a vertical position about its pivotal connection to the lower rod section and the assembly lowered such that the arm 21 extends toward the nozzle 14. As the descent continues, lower portion 17 of the tube 15 engages the bore in the nozzle 14; and when the lugs 16 engage the upper periphery of the nozzle 14, tube 15 is in place. As the bottom section 20 continues to descend, the arm 29 rotates into its vertical position; whereupon the assembly can be raised and removed from the flue 10.

With reference to FIG. 5 and FIGS. 6*a*–6*c*, there is shown a device for removing a burner tube 15 from a burner nozzle 14. It again includes upper and lower rod sections 19 and 20 which are identical to those previously described. As was the case with the device of FIGS. 3, 4*a* and 4*b*, the lower rod section 20 carries at its lower end a clevis having spaced arms 35 and 36 which carry at their lower ends a taper plug 34. A pin 37 interconnects the two arms 35 and 36; however in this case the axis of the pin 37 intersects the axis of the lower rod section 20. Pivotally carried on the pin 37 are link arms 38 and 39 and disposed intermediate the clevis arms 35 and 36. Normally, the link arms 38 and 39 will assume the horizontal positions shown in FIG. 6*a*. However, when the rod section 20 is lowered to the point where the link arms engage the upper periphery of the burner tube 15, they will pivot upwardly and inwardly into the positions shown in FIG. 6*b* whereby the assembly can pass downwardly through the tube 15. Once the link arms 38 and 39 clear the lower edge of the tube 15, they again fall outwardly and downwardly into the positions shown in FIG. 6*c*. Now, when the rod section 20 is pulled upwardly, the link arms 38 and 39 will engage the lower edge of the tube 15, thereby pulling it upwardly and out of the burner nozzle 14.

In FIG. 7, a cleaning plug 41 is shown which can be attached to the bottom of the lower rod section 20. The underside of the cleaning plug 41 is provided with an annular cutting edge 42 which, when the plug 41 enters the bore in burner nozzle 14, will remove accumulations such as graphite which have formed on the edges. This cleaning operation will normally take place prior to the insertion of a new burner tube into the nozzle.

Although the invention has been shown in connection with certain specific embodiments, it will be readily apparent to those skilled in the art that various changes in form and arrangement of parts may be made to suit requirements without departing from the spirit and scope of the invention.

We claim as our invention:

1. A burner tube adapted to pass through an opening in the roof of a coke oven for insertion into a burner nozzle in the sole of a vertical heating flue for the coke oven, the lower portion of said burner tube being insertable into a bore in the nozzle with its outer periphery abutting the inner periphery of the nozzle and having radially-extending lugs on its outer periphery which rest on the upper surface of the burner nozzle when said lower portion of the burner tube is inserted therein, said burner tube being of constant diameter except at said lugs and having a wall thickness no greater than 6 millimeters throughout its length, and said burner tube being formed of fired alumina of at least 99.9% purity.

2. A burner tube according to claim 1, characterized in that the lower portion of the tube which is inserted into said bore in the nozzle below the radially-extending lugs has a length of at least 100 millimeters.

3. A burner tube adapted to pass through an opening in the roof of a coke oven for insertion into a burner nozzle in the sole of a vertical heating flue for the coke oven, the lower portion of said burner tube being insertable into a bore in the burner nozzle such that its outer periphery is in abutment with the inner periphery of the bore and having radially-extending lugs on its outer periphery which rest on the upper surface of the burner nozzle when said lower portion of the burner tube is inserted therein, the burner tube being cylindrical in configuration and formed from alumina of at least 99.9% purity, the lower portion of the burner tube having a length of at least 100 millimeters, and the wall thickness of said burner tube being 6 millimeters or less and uniform throughout its entire length except at said lugs.

* * * * *